US006902346B2

(12) United States Patent
Steig, Jr. et al.

(10) Patent No.: US 6,902,346 B2
(45) Date of Patent: Jun. 7, 2005

(54) HYDRAULIC COUPLER

(75) Inventors: Kenneth M. Steig, Jr., Mooringsport, LA (US); Richard A. Thompson, Keatchie, LA (US); Robert K. Hawkins, Arlington, TX (US); Wilson A. Jones, Shreveport, LA (US)

(73) Assignee: Hendrix Manufacturing, Ltd., Mansfield, LA (US)

( * ) Notice: Subject to any disclaimer, the term of this patent is extended or adjusted under 35 U.S.C. 154(b) by 247 days.

(21) Appl. No.: 10/097,859

(22) Filed: Mar. 15, 2002

(65) Prior Publication Data

US 2003/0175072 A1 Sep. 18, 2003

(51) Int. Cl.[7] ..... B25G 3/18; E02F 3/96

(52) U.S. Cl. ..... 403/322.3; 403/321; 403/322.4; 37/468

(58) Field of Search ..... 172/683; 37/468; 414/686, 723; 403/321, 322.1, 322.3, 315, 322.4, 326

(56) References Cited

U.S. PATENT DOCUMENTS 4,243,356 A 1/1981 Takojima
4,247,243 A 1/1981 Carter
4,295,287 A 10/1981 Natzke et al.
4,545,720 A 10/1985 Cochran et al.
4,854,813 A 8/1989 Degeeter et al.
5,082,389 A 1/1992 Balemi
5,141,385 A 8/1992 Tibbatts et al.
5,324,162 A 6/1994 Kishi
5,332,353 A 7/1994 Arnold
5,456,030 A 10/1995 Barone et al.
5,634,735 A 6/1997 Horton et al.
5,692,852 A 12/1997 Collins
5,820,332 A 10/1998 Philips et al.
5,951,192 A 9/1999 Collins
6,058,633 A * 5/2000 Barden ..... 37/468

* cited by examiner

*Primary Examiner*—Daniel P. Stodola
*Assistant Examiner*—Victor MacArthur
(74) *Attorney, Agent, or Firm*—Breiner & Breiner, L.L.C.

(57) ABSTRACT

A quick coupler for attaching implements, such as buckets or other tools, to heavy equipment, such as backhoes and excavators, which includes two recesses or channels for receiving a pair of machine pins of an implement. A hydraulic piston actuates a first locking lever to enclose one of the pair of machine pins in one recess and a second locking lever to enclose the other one of the pair of machine pins in the other recess.

9 Claims, 4 Drawing Sheets

HYDRAULIC COUPLER

FIELD OF THE INVENTION

This invention relates to an improved coupler for quickly connecting and disconnecting construction implements such as excavator buckets and other tools to and from heavy construction equipment such as backhoes or other earth-moving machines. More particularly, this invention relates to a quick coupler having two locking levers jointly actuated by a hydraulic cylinder, each lever associated with a recess in the coupler for receiving and securing therein one of a pair of machine pins of the construction implement.

BACKGROUND OF THE INVENTION

Couplers are widely used in the construction industry, more specifically in the earth moving industry, in combination with excavating equipment such as excavators and backhoes to enable excavating equipment to be used with a variety of tools. Thus, a good coupler can greatly expand the utility of a single piece of equipment. For example, a backhoe fitted with a coupler can be interchangeably equipped with shovels, ripper tooths, hydraulic hammers and the like thereby diversifying the uses of the backhoe.

An important characteristic of a coupler is the amount of time required to detach and attach the construction implements thereto. This amount of time is usually referred to as downtime. Downtime can be greatly minimized by employing quick couplers, i.e., couplers which can be quickly attached to and detached from the implement without having to do so manually, as opposed to couplers which require a worker, for example, to remove and attach implements to a coupler by hand. U.S. Pat. No. 5,082,389 to Balemi, the disclosure of which is incorporated herein by reference, discloses such a quick coupler.

Another important characteristic of a coupler is the manner in which the coupler attaches to an implement. Quick couplers, such as disclosed in Balemi, typically rely on two recesses in the coupler for receiving a pair of machine pins of the implement. A single closure member is associated with one of the recesses for locking one of the pins within one recess. The second machine pin is indirectly held within the second recess by the action of the closure member associated with the first recess. Accordingly, only one of the pair of machine pins is structurally locked within a recess.

FIGS. 1 and 2 show another prior art quick coupler, namely, the JB Quick Coupler manufactured and sold by Hendrix Manufacturing Company, Inc. of Mansfield, La., the owner of the present invention. FIG. 1 shows the coupler in the open position, or before attachment of the implement, and FIG. 2 shows the coupler in the closed position, or after the implement is attached. This JB Quick Coupler, which has been quite successful, generally comprises a body having two recesses for receiving the machine pins of the implement, a locking lever and a hydraulic cylinder for actuating the locking lever. More specifically, it includes a pair of opposed, parallel side plates 2 having a front 3 and a rear 5. Side plates 2 are interconnected and held in parallel relation by a flat, rectangular transverse plate 4 suspended between and attached at each respective end thereof to side plates 2 near the rear of the coupler. A forward-facing, C-shaped transverse plate 6 is suspended between and attached at each respective end thereof to side plates 2 near the front 3 of the coupler. C-shaped transverse plate 6 defines an open, forward-facing recess 7 in the front of side plates 2.

Interposed between side plates 2 and transverse plates 4 and 6 there is a rear-facing locking lever 8 pivotally attached to side plates 2 by a pin 9. Locking lever 8 is arranged to pivot rearward to block an open, downward-facing recess 10 which is defined at each end thereof by a notch 11 in each of side plates 2 near the rear of the coupler. Locking lever 8 is pivoted by an actuator 12, such as an hydraulic cylinder.

More particularly, side plates 2 of the JB Quick Coupler comprise a pair of opposed upper plates 14 having a pair of spaced-apart apertures 16 which provide a means of attaching the quick coupler to the boom of a piece of equipment and a pair of opposed lower plates 18 welded thereto which include rear recess 10 and front recess 7. Recesses 7 and 10, in combination with locking lever 8 and actuator 12, provide a means of attaching an implement to the coupler. Specifically, as illustrated in FIGS. 1 and 2 locking lever 8 is arranged to pivot down and rearward when urged by actuator 12 to lock a machine pin of the implement in place in recess 10.

To employ the JB Quick Coupler, the coupler is first manually attached to the end of a boom (not shown) of a piece of equipment by inserting locking pins through apertures 16 in upper plates 14 and concurrently through a set of complementary apertures in the boom. Next, the quick coupler is maneuvered, while in an open position as illustrated in FIG. 1, over an implement and lowered so that one of a pair of machine pins of the implement is positioned within recess 7. The rear of the coupler is then tilted downward so that the other machine pin of the implement is maneuvered into recess 10. As illustrated in FIG. 2, closure member 8 is urged down and rearward by an actuator rod 19 of actuator 12 into recess 10 to lock the machine pin of the implement within recess 10. Compression springs (not shown) are included on each lateral side of actuator rod 19 to act as a redundant safety back-up for closure member 8 in the event actuator 12 fails. To detach the implement from the coupler, closure member 8 is simply urged forward and up, away from recess 10, freeing the attachment rod seated therein.

The JB Quick Coupler has performed well in the field. However, Hendrix Manufacturing, the assignee of this invention, has sought to further improve quick couplers as described hereafter.

OBJECTS AND SUMMARY OF THE INVENTION

A primary object of the quick coupler of this invention is to provide a means of quickly attaching, retaining and detaching earth-moving implements from heavy construction equipment wherein the quick coupler includes a body, recesses for receiving machine pins of an implement, front and rear locking levers and an actuator to move the locking levers.

A further primary object of the invention is to provide a quick coupler having both a first locking lever and a second locking lever actuated by at least one hydraulic cylinder. The second locking lever of the invention provides for additional security in locking the construction implement in place.

A further primary object of the invention is to provide a quick coupler having a first locking lever associated with a rear recess and a second locking lever associated with a front recess, the locking levers being interconnected by an actuator suspended therebetween.

Another object of the invention is to provide a quick coupler having a first locking lever associated with a rear recess, the locking lever being actuated to close the rear recess by a first actuator and a second locking lever associated with a front recess, the second locking lever being actuated to close the front recess by a second actuator.

The objects of the invention are accomplished by providing a quick coupler comprising a body, recesses in the body for receiving machine pins of a construction implement, first and second locking levers to open and close the recesses and an actuator interconnected to the locking levers to move the levers into open and close positions.

More specifically, the quick coupler of the present invention comprises a pair of opposed side plates having a front and a rear, the side plates being arranged in parallel and interconnected by a transverse plate at the rear of the side plates and a forward-facing, C-shaped transverse plate at the front of the side plates. Optionally, a flat, rectangular loop plate having a loop thereon can be suspended between and attached at each end thereof to the side plates to further connect the side plates, as well as provide a point of attachment to the coupler of items by a wire, hook or the like.

A rear-facing locking lever is interposed between the opposed side plates and pivotally attached therebetween. This locking lever is constructed and arranged to close a downward-facing rear recess in the side plates.

Additionally, there is interposed between the side plates and pivotally attached therebetween a second locking lever constructed and arranged to close a front recess of the coupler defined by the C-shaped transverse plate. An actuator, preferably a hydraulic cylinder, is attached at one end thereof to the first locking lever and at an opposite end to the second locking lever to move these levers into an open and close position. Optionally, these locking levers can be urged by separate actuators so that in the event one actuator fails, the other can continue to effectually close the respective recess. Under this latter arrangement, the actuators are attached at one end to the first or second locking lever and at an opposite end to a stationary section of the coupler such as the side plates.

More particularly, the side plates of the present invention comprise a pair of opposed upper plates and a pair of opposed lower plates which are welded directly to and partially overlap the upper plates. Each plate of the upper plates includes a pair of aligned, spaced-apart apertures which, in combination, provide a means of attaching the quick coupler to the end of a boom of a piece of equipment. The lower plates each include a rear notch which defines the rear recess and a front notch which, in combination with the C-shaped transverse plate, defines the front recess. Optionally, a spacer plate can be fixed between the upper plates and lower plates which covers the area of overlap between the upper plates and lower plates.

As explained above, an actuator is attached at one end to the first locking lever and at the opposite end to the second locking lever. Under this arrangement, when urged by the actuator, the rear locking lever is caused to pivot down and rearward to close the rear recess, and the front locking lever is caused to pivot down and forward to close the front recess. As a result, a machine pin seated in either recess is directly retained therein by the locking levers. A more secure and safe connection between the quick coupler and implement is realized than currently enjoyed by the known quick couplers.

DETAILED DESCRIPTION AND PRESENTLY PREFERRED EMBODIMENTS

Figure 1:
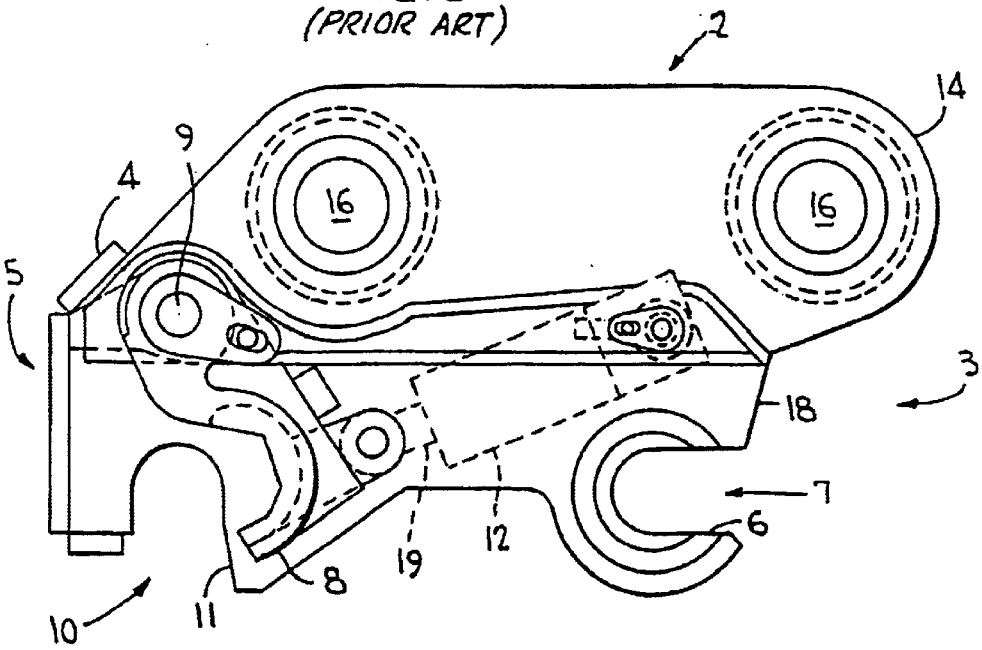
FIG. 1 (PRIOR ART)
FIG. 1 is a partial, cross-sectional view of a quick coupler of the prior art in an open position.
Figure 2:
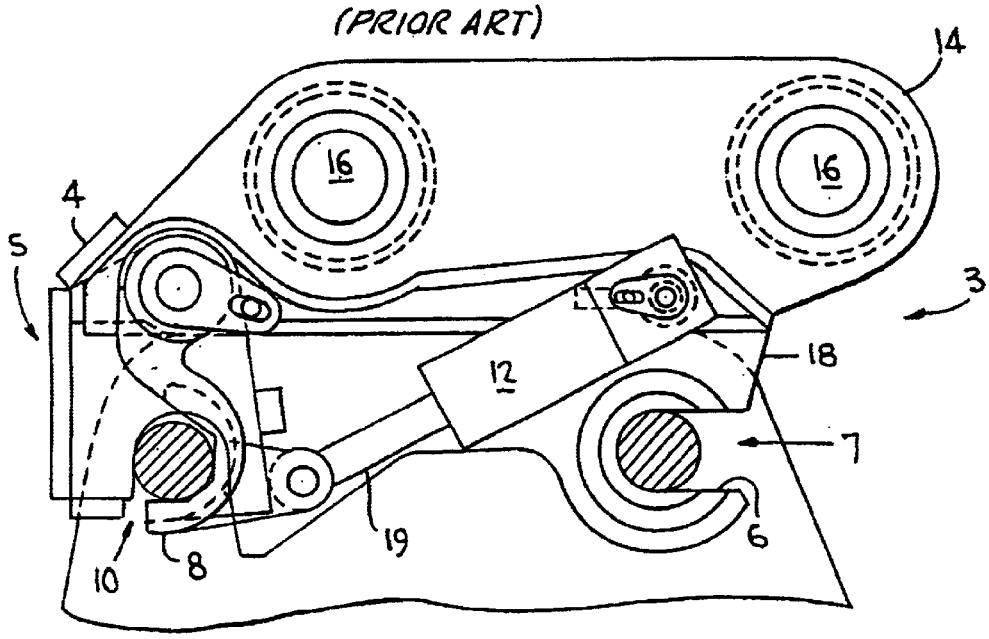
FIG. 2 (PRIOR ART)
FIG. 2 is a partial, cross-sectional view of a quick coupler of FIG. 1 in a closed position.

A quick coupler in accordance with the preferred embodiment of the present invention is illustrated in FIGS. 3 through 7, where like features of the invention share like numbering. The quick coupler depicted therein generally comprises a pair of interconnected, parallel side plates 22 having a front 23 and a rear 25 and therebetween a first locking lever 24 for closing a rear recess 26 formed between side plates 22, a second locking lever 28 for closing a front recess 30 also formed between side plates 22 and an actuator 62 for simultaneously urging the locking levers 24 and 28 into rear recess 26 and front recess 30, respectively.

More particularly, the side plates 22 of the quick coupler comprises three pairs of opposed, parallel plates, namely upper plates 32, spacer plates 34 and lower plates 36. It is understood however, that two opposed, parallel one piece form plates may be used in place of upper plates 32, spacer plates 34 and lower plates 36.

Figure 3:
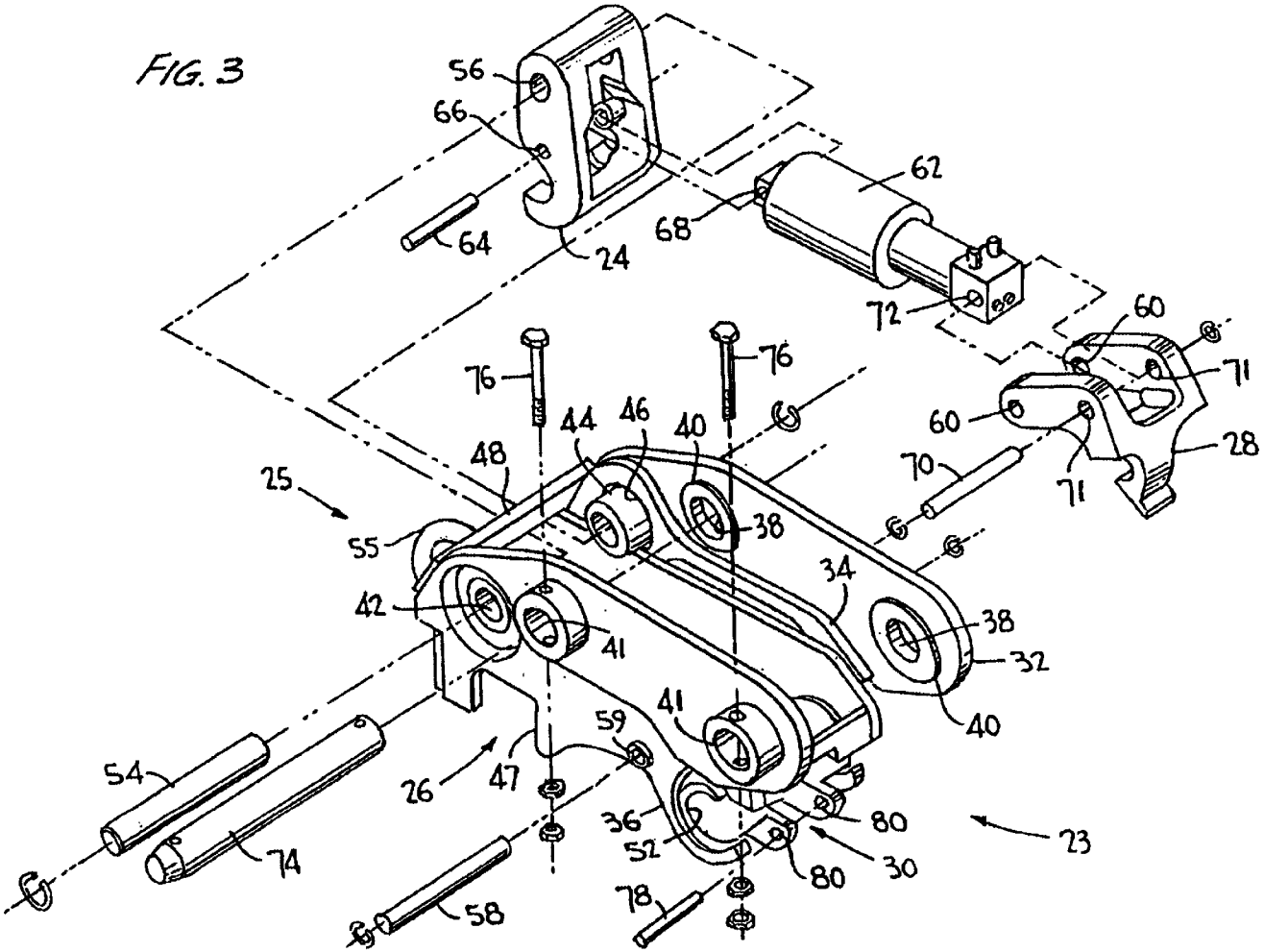
FIG. 3 is an exploded view of a quick coupler representative of a preferred embodiment of the present invention.

As illustrated, for example, in FIG. 3, each plate of upper plates 32 comprises a generally flat, metal plate having two spaced-apart apertures 38 which are aligned with the apertures 38 in the opposed upper plate. Seated within openings 38 are collars 40 which line apertures 38 and protrude outward therefrom, forming passageways 41 which are likewise aligned with the passageways 41 formed in the opposed upper plate. Each plate of upper plates 32 further includes a rear bore 42 which is aligned with the rear bore 42 in the opposed upper plate. A raised, circular rim 44 is circumposed about each bore 42 on the inside surface of the upper plates for reasons described below.

Each plate of spacer plates 34 comprises a generally flat, metal plate having an opening 46 for receiving the rim 44 of a respective upper plate. Specifically, spacer plates 34 are arranged to lie flat against upper plates 32 with a respective opening 46 circumposed about the rim 44 of a respective upper plate. As illustrated, for example, in FIGS. 4 and 5, when mounted on upper plates 32, spacer plates 34 slightly overhang the lower edge of upper plates 32 and extend upward therefrom, lying flat against the inside surface of upper plates 32, to a point just below a respective opening 38.

Figure 4:
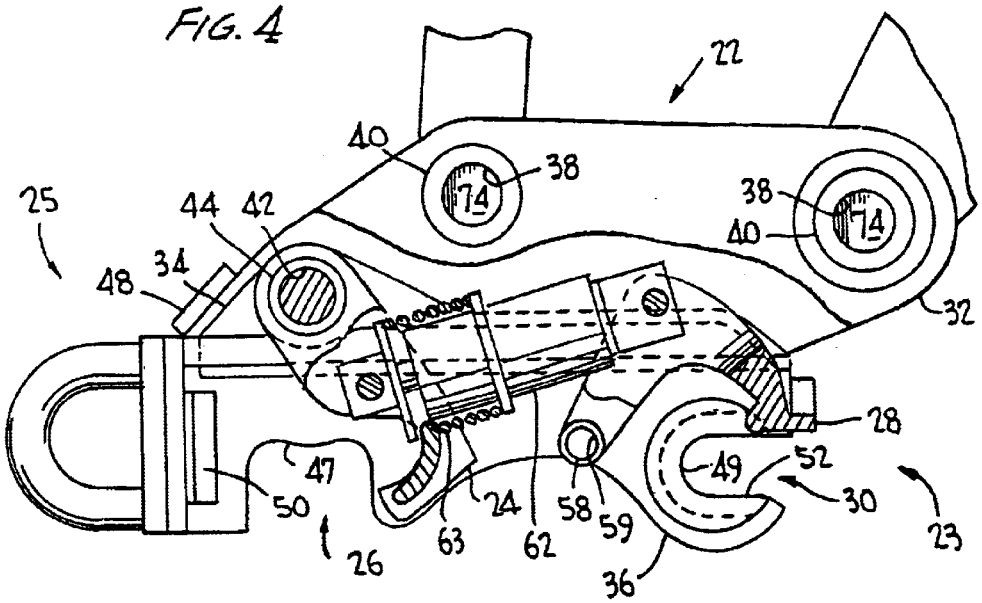
FIG. 4 is a partial, cross-sectional view of the quick coupler of FIG. 3 in an open position.
Figure 5:
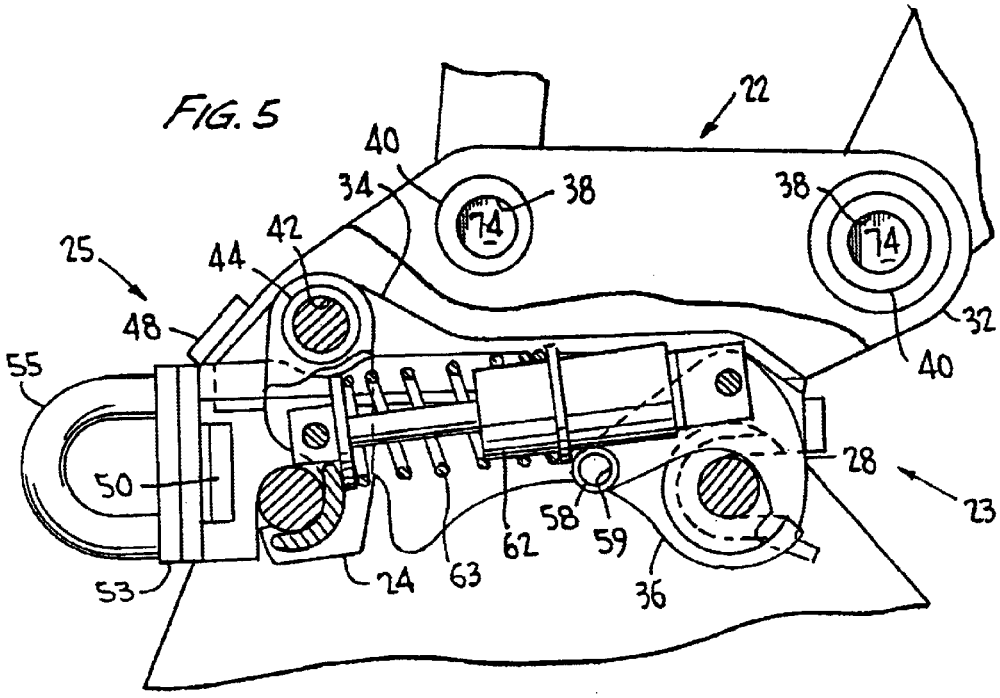
FIG. 5 is a partial, cross-sectional view of a quick coupler representative of FIG. 3 in a closed position.

Each plate of lower plates 36 comprises a generally flat, metal plate constructed and arranged to lie flat against the inside surface of a respective one of spacer plates 34 such that spacer plates 34 are sandwiched between upper plates 32 and lower plates 36. As illustrated in FIGS. 4 and 5, lower plates 36 extend downward beyond the lower edge of spacer plates 34 and upper plates 32 forming at the lower, rear edge thereof a pair of rear notches 47 which define rear recess 26 and at the front edge thereof a pair of front notches 49 which, in part, define front recess 30.

Side plates 22, including upper plates 32, spacer plates 34 and lower plates 36, are interconnected and maintained in parallel relation by three transverse plates which extend between side plates 22. A first transverse plate 48 extends between and is attached at either end thereof to a respective upper plate of upper plates 32 at the rear of the quick coupler. First transverse plate 48 generally comprises a flat, rectangular strip of metal. A second, C-shaped transverse plate 52 extends between lower plates 36 at the front of the coupler. More specifically, second transverse plate 52 extends between and is seated within front notches 49, and thus, is arranged to sit within and to further define recess 30. A third, transverse hook plate 53 having an eye 55 is suspended between and attached at either end thereof to the rear of lower plates 36. A pair of corner braces 50 are used to strengthen the attachment of hook plate 53 to lower plates 36. In addition to strengthening the quick coupler, hook plate 53 provides a point of attachment, namely eye 55, for suspending items from the coupler, for example, by a wire cable or the like. In the alternative, a fourth transverse plate may extend between the side plates 22 to interconnect and maintain the side plates in parallel relation.

Associated with and arranged to close rear recess 26, locking lever 24 is pivotally fixed between side plates 22 by a pin 54 which is inserted through each rear bore 42 in upper plates 32 and concurrently through a first pair of aligned holes 56 in locking lever 24. Locking lever 24 is constructed and arranged to pivot downward and rearward about pin 54 to close rear recess 26. Similarly, associated with and arranged to close front recess 30, locking lever 28 is pivotally fixed between side plates 22 by pin 58 which is inserted through a pair of aligned holes 59 in lower plates 36 and concurrently through holes 60 in locking lever 28. Locking lever 28 is adapted to pivot downward and forward about pin 58 to close front recess 30.

To actuate locking levers 24 and 28, an hydraulic cylinder 62 is attached at either end thereof and suspended between locking levers 24 and 28. Cylinder 62 can be said to "float" between locking levers 24 and 28. More specifically, hydraulic cylinder 62 is attached at an end thereof to locking lever 24 by a pin 64 which is inserted through a second pair of aligned holes 66 in locking lever 24 and concurrently through a first aperture 68 in hydraulic cylinder 62. Likewise, hydraulic cylinder 62 is attached at an end opposite locking lever 24 to locking lever 28 by a second pin 70 which is inserted through a second pair of aligned holes 71 in locking lever 28 and concurrently through a second aperture 72 in hydraulic cylinder 62. The hydraulic cylinder assembly 62 is controlled, for example, through controls positioned in the cab or otherwise in the vehicle from which the boom extends.

Since the quick coupler of the present invention is designed to operate in combination with heavy machinery, it is preferred that the various components of the coupler, namely the load bearing components such as side plates 22 and transverse plates 48 and 52 be constructed of high strength plate steel. Additionally, locking levers 24 and 28 are constructed of cast high strength, low alloy steel.

To operate the quick coupler, it is first attached to an end of a boom of a piece of equipment. To do so, an end of a boom (not shown) is maneuvered between side plate 22, and machine pins 74 are inserted through pin openings formed in the end of the boom and concurrently through passageways 41 and openings 38 in upper plates 32. To lock in machine pins 74 within the pin openings, passageways 41 and openings 38, locking pins 76 are inserted through collars 40 and through machine pins 74 as illustrated in FIG. 3. Thus, the quick coupler is securely locked to the end of the boom.

Figure 6:
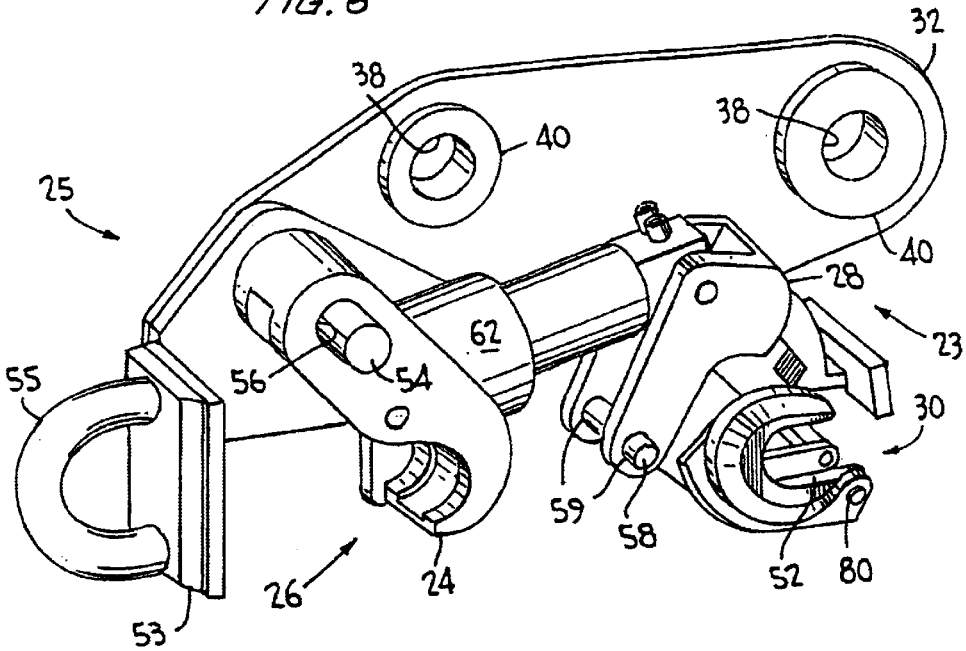
FIG. 6 is a partial, perspective view of a quick coupler of FIG. 3 in the open position.
Figure 7:
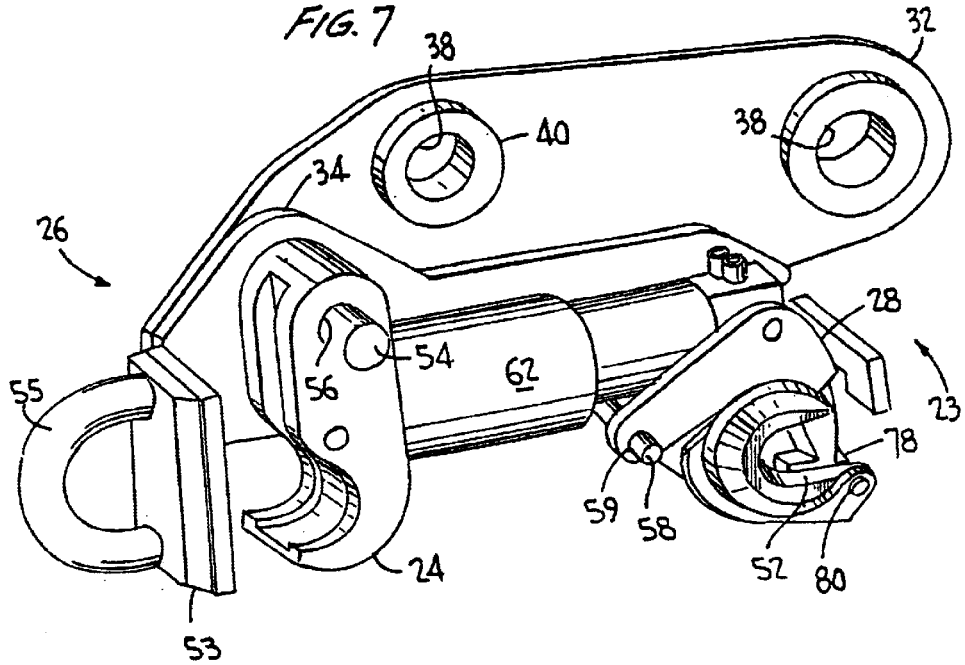
FIG. 7 is a partial, perspective view of a quick coupler of FIG. 3 in the closed position.

To attach an implement (not shown), such as a bucket or ripper, to the coupler, the boom is maneuvered to position the quick coupler above the implement. The coupler is oriented so that front recess 30 is directed downward toward the implement. The coupler is lowered onto the implement so that one of a pair of parallel machine pins of the implement is forced into and seated within front recess 30. The rear of the quick coupler is next pivoted down, so that rear recess 26 is moved toward the other machine pin of the implement. The machine pin is then seated within rear recess 26. To lock or secure the machine pins within recesses 26, 30, hydraulic cylinder 62 is actuated by extending the piston portion thereof and causing locking lever 24 to pivot down and rearward toward recess 24 until locking lever 24 closes the recess. Likewise, locking lever 28 is simultaneously caused to pivot down and forward toward front recess 30 to close the recess and secure the machine pin of the implement. As illustrated only in FIGS. 4 and 5 for convenience, hydraulic cylinder 62 includes a compression spring 63 about the piston portion of hydraulic cylinder 62 which acts as a redundant safety back-up for locking lever 24 and lever 28 in the event hydraulic cylinder 62 fails. Further, as illustrated in FIGS. 3, 6 and 7 only, a locking pin 78 is inserted through a pair of aligned openings 80 in C-shaped transverse plate 52 to prevent locking lever 28 from releasing the machine pin. At this point, the implement is securely connected to the coupler and boom, and ready for work.

Release of the implement is realized by removing locking pin 78 and actuating hydraulic cylinder 62 to retract and withdraw locking lever 24 from rear recess 26 and locking lever 28 from front recess 30. Once locking levers 24 and 28 are sufficiently withdrawn, the coupler is detached from the implement by tilting the rear of the coupler upward, followed by moving the entire coupler upward, away from the implement.

While the preferred embodiment of the quick coupler has been described in detail above, various modifications and variations of the invention are possible in light of the above teachings. For example, while the recesses are defined as above, the recesses may have different shapes or face in different directions. Further, while the invention calls for a single, "floating" hydraulic cylinder, two or more hydraulic cylinders may be used, whether they be "floating" or attached to the side plates or transverse plates. Similarly, the hydraulic cylinder of the invention can be replaced by any actuating means capable of maneuvering the locking levers as described above. It is, therefore, to be understood that within the scope of the appended claims the invention may be practiced otherwise than above-described.

What is claimed is:

1. A coupler for releasable connection to a boom of a piece of equipment and for attaching an implement, the coupler comprising:

a body comprising a pair of interconnected opposed plates having an upper portion and a lower portion, said upper portion having means for releasably connecting said coupler to the boom of said piece of equipment and said lower portion having a first recess and a second recess for releasable connection to said implement;

a first lever pivotably connected to said body between said plates for blocking said first recess to attach said implement;

a second lever pivotably connected to said body between said plates for blocking said second recess to attach said implement, and an actuator connected at one end thereof to said first lever and at the opposite end thereof to said second lever, wherein in operation said actuator pivotably moves said first lever and said second lever to engage and attach said implement and to disconnect said implement.

2. A coupler in accordance with claim 1 wherein said upper portion comprises a first pair of spaced apart plates and said lower portion comprises a second pair of spaced apart plates.

3. A coupler in accordance with claim 1 wherein said means of releasably connecting said coupler to said boom comprises a pair of spaced apart passageways.

4. A coupler in accordance with claim 2 further comprising a pair of spaced apart apertures in each plate of said first pair of spaced apart plates.

5. A coupler in accordance with claim 4 wherein said first recess is defined by a first notch in each plate of said second pair of spaced apart plates and said second recess is defined by a second notch in each plate of said second pair of spaced apart plates.

6. A coupler in accordance with claim 1 wherein said first lever is attached to said upper portion and said second lever is attached to said lower portion.

7. A coupler in accordance with claim 1 wherein said actuator is a hydraulic cylinder.

8. A coupler in accordance with claim 5 wherein said first notch opens downward and said second notch opens forward.

9. A coupler in accordance with claim 8 wherein said first lever and said second lever pivot in a common direction.

* * * * *